US006729231B2

(12) United States Patent
Lan

(10) Patent No.: US 6,729,231 B2
(45) Date of Patent: May 4, 2004

(54) WORKPIECE CARRIER POSITIONING STRUCTURE FOR AUTO PRINTING AND DRYING MACHINE

(76) Inventor: Chin-Wang Lan, PO Box 82-144, Taipei (TW)

( * ) Notice: Subject to any disclaimer, the term of this patent is extended or adjusted under 35 U.S.C. 154(b) by 0 days.

(21) Appl. No.: 10/265,122

(22) Filed: Oct. 7, 2002

(65) Prior Publication Data

US 2004/0065217 A1 Apr. 8, 2004

(51) Int. Cl.[7] ..... B05C 17/06
(52) U.S. Cl. ..... 101/126; 101/123
(58) Field of Search ..... 101/114, 115, 101/123, 126, 129, 35, 43, 44; 198/345.1, 345.2, 345.3, 465.1, 465.2, 465.3

(56) References Cited

U.S. PATENT DOCUMENTS 3,596,704 A * 8/1971 Roe ..... 164/326
3,795,189 A * 3/1974 Jaffa ..... 101/123
4,031,825 A * 6/1977 Jaffa ..... 101/126
4,099,460 A * 7/1978 Bubley et al. ..... 101/44
4,407,195 A * 10/1983 Jaffa ..... 101/123
4,735,139 A * 4/1988 Szarka ..... 101/126
4,909,146 A * 3/1990 Szarka ..... 101/126
4,928,806 A * 5/1990 Anderson et al. ..... 198/345.1
5,607,243 A * 3/1997 Szarka ..... 101/126
6,289,802 B1 * 9/2001 Zelko ..... 101/115

* cited by examiner

*Primary Examiner*—Ren Yan
(74) *Attorney, Agent, or Firm*—Leong C. Lei

(57) ABSTRACT

A workpiece carrier positioning structure used in an auto printing and drying machine for controlling positioning of a workpiece carrier fixedly carried on a carriage sliding in a track, for enabling the workpiece carrier to be positively maintained in a printing/drying position, in which the workpiece carrier is transversely slidably mounted on transverse axles at the carriage and supported between compression springs on the transverse axles, and a longitudinal slide is controlled by an air cylinder to move a notched stop block into engagement with a roller at the bottom side of the workpiece carrier to hold the workpiece carrier in the printing/drying position when the carriage approached.

1 Claim, 7 Drawing Sheets

WORKPIECE CARRIER POSITIONING STRUCTURE FOR AUTO PRINTING AND DRYING MACHINE

BACKGROUND OF THE INVENTION

1. Field of the Invention

The present invention relates to a printing and drying machine and, more particularly, to a workpiece carrier positioning structure for use in an auto printing and drying machine to position the workpiece carrier of each carriage accurately in position for enabling the carried workpiece to be printed or dried by the corresponding printing module or drying module.

2. Description of the Related Art

Conventionally, auto-rotary printers are used for printing T-shirts and various cut-pieces. An auto-rotary printer for this purpose comprises a driving mechanism at the center, and a plurality of printing modules respectively located on the radial rod (members of the driving mechanism. A circular conveyer system is provided below the printing modules, carrying a plurality of workpiece carriers. The circular conveyer system is rotated intermittently. Upon each stroke of the motion of the circular conveyer system, the driving mechanism is operated to lower the printing modules, thereby causing the printing modules to print the desired printing on the T-shirt or cut-piece on each workpiece carrier. The printed T-shirts or cut-pieces are further delivered through a drying unit and then well dried. This design of auto-rotary printer is not extendable, i.e., the number of the printing modules cannot be reduced or increased subject to the desired capacity. Further, this design of auto-rotary printer requires much installation space.

In order to eliminate the aforesaid drawbacks, the present invention invented an extendable auto printing and drying machine that can be extended subject to the desired capacity. This design of extendable auto printing and drying machine is functional. However, it still has a small drawback. When printing or drying the T-shirt or cut-piece on the corresponding workpiece carrier, the workpiece carrier tends to be vibrated by the corresponding printing module or drying module, affecting the performance of the printing or drying action.

SUMMARY OF THE INVENTION

The present invention has been accomplished under the circumstances in view. It is main object of the present invention to provide a workpiece carrier positioning structure for use in an auto printing and drying machine, which accurately positively holds the workpiece carrier of the corresponding carriage in position for enabling the carried workpiece to be printed or dried by the corresponding printing module or drying module accurately. According to the present invention, the workpiece carrier is transversely slidably mounted on transverse axles at the carriage and supported between compression springs on the transverse axles, and a longitudinal slide is controlled by an air cylinder to move a notched stop block into engagement with a roller at the bottom side of the workpiece carrier to hold the workpiece carrier in the printing/drying position positively when the carriage approached.

DETAILED DESCRIPTION OF THE PREFERRED EMBODIMENT

Figure 1:
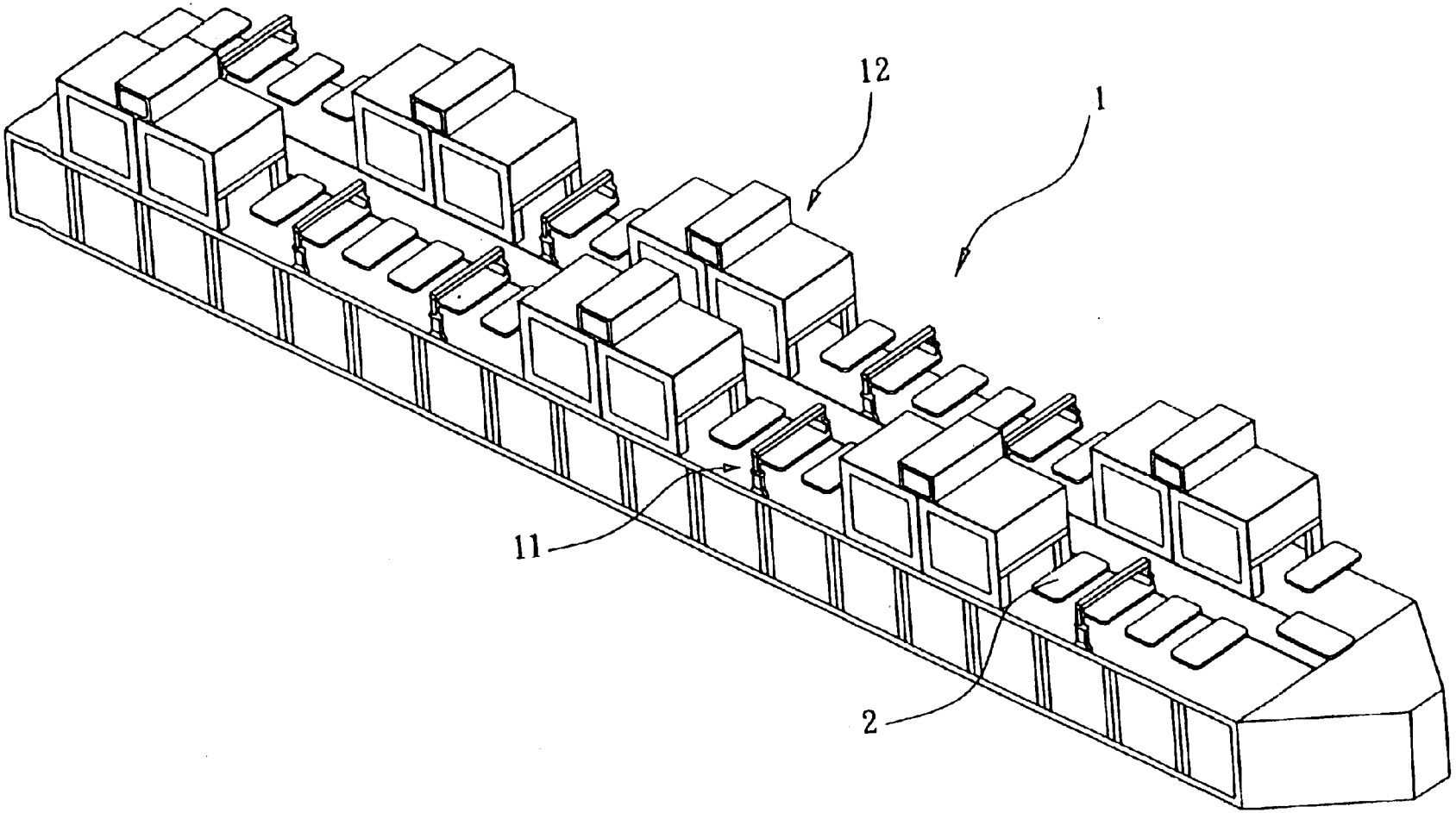
FIG. 1 is an elevational view of an extendable auto printing and drying machine constructed according to the present invention.
Figure 4:
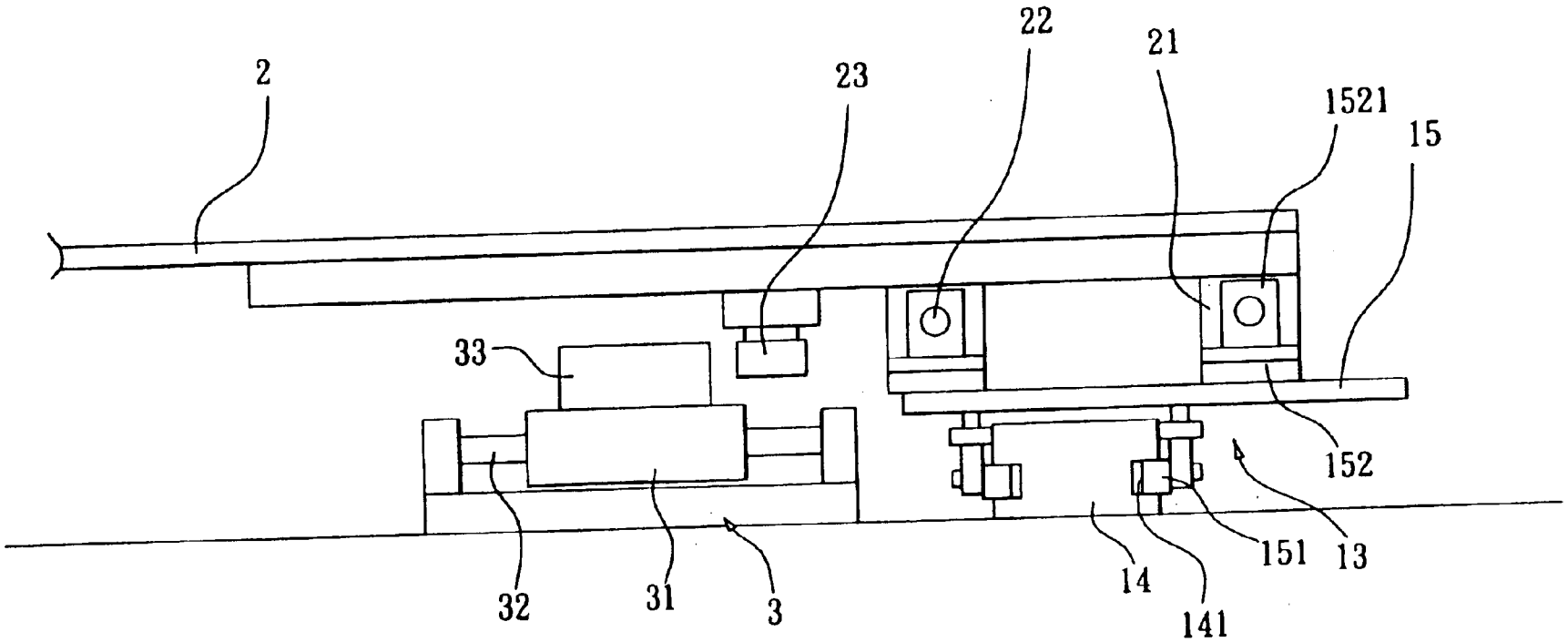
FIG. 4 is a front plain view of FIG. 3.

Referring to FIGS. 1 and 4, the auto printing and drying machine 1 is shown comprising a plurality of printing modules 11 and a plurality of drying modules 12, an endless chain conveyer system (not shown) coupled to a motor drive (not shown), and a plurality of carriages 13 (see FIG. 4) installed in the endless chain conveyer system. Each carriage 13 has a workpiece carrier 2 adapted to hold a T-shirt or cut-piece for printing by one printing module 11 and then drying by one drying module 12. During the operation of the auto printing and drying machine 1, the motor drive intermittently rotate the chain conveyer system to move the carriages 13, keeping the carriages 13 to be alternatively stopped below the printing modules 11 and the drying modules 12 for a predetermined length of time, enabling the T-shirt or cut-piece to be printed or dried.

Figure 2:
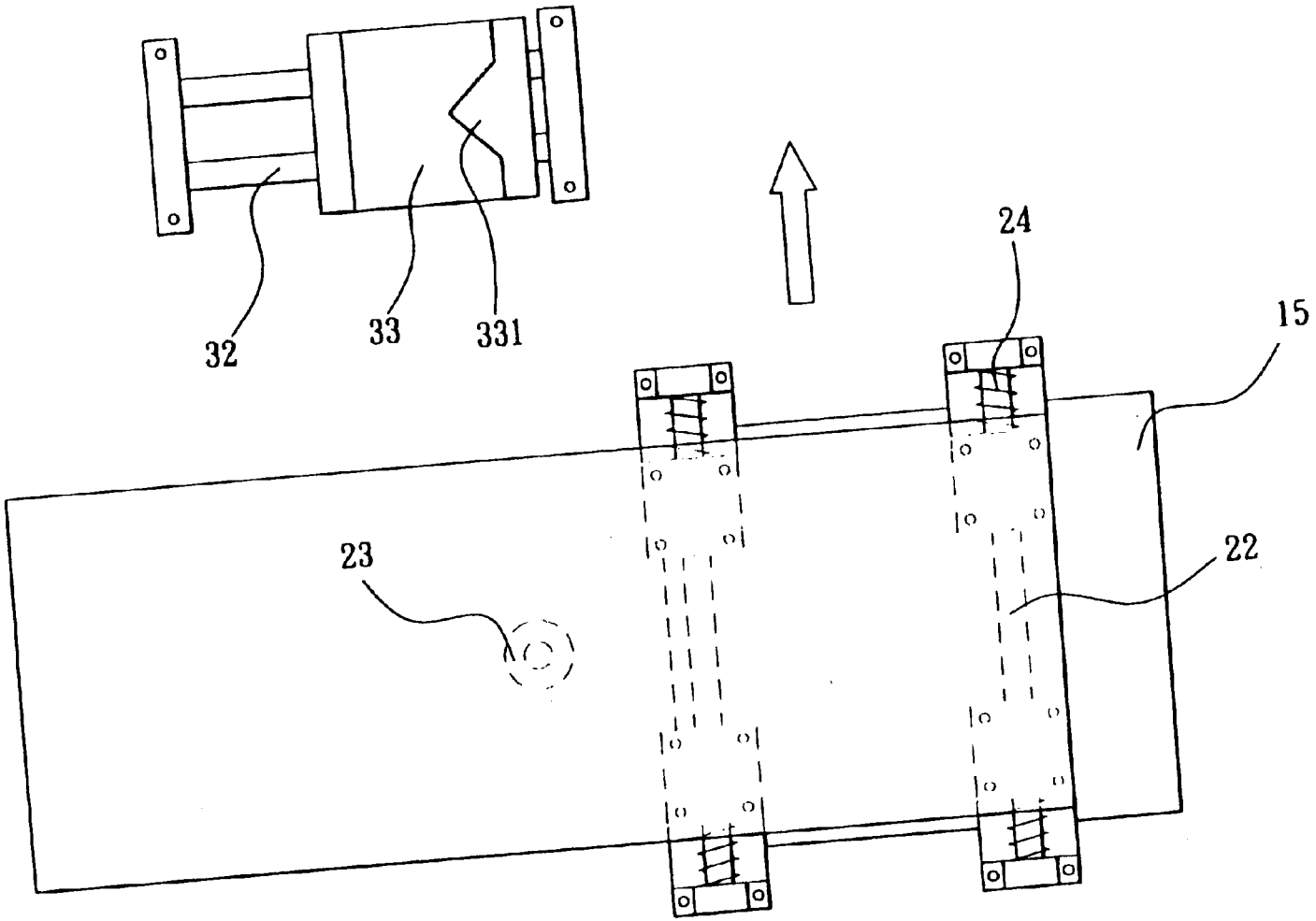
FIG. 2 is schematic top plain view of the present invention, showing the moving direction of the workpiece carrier with the carriage relative to the stop block.
Figure 3:
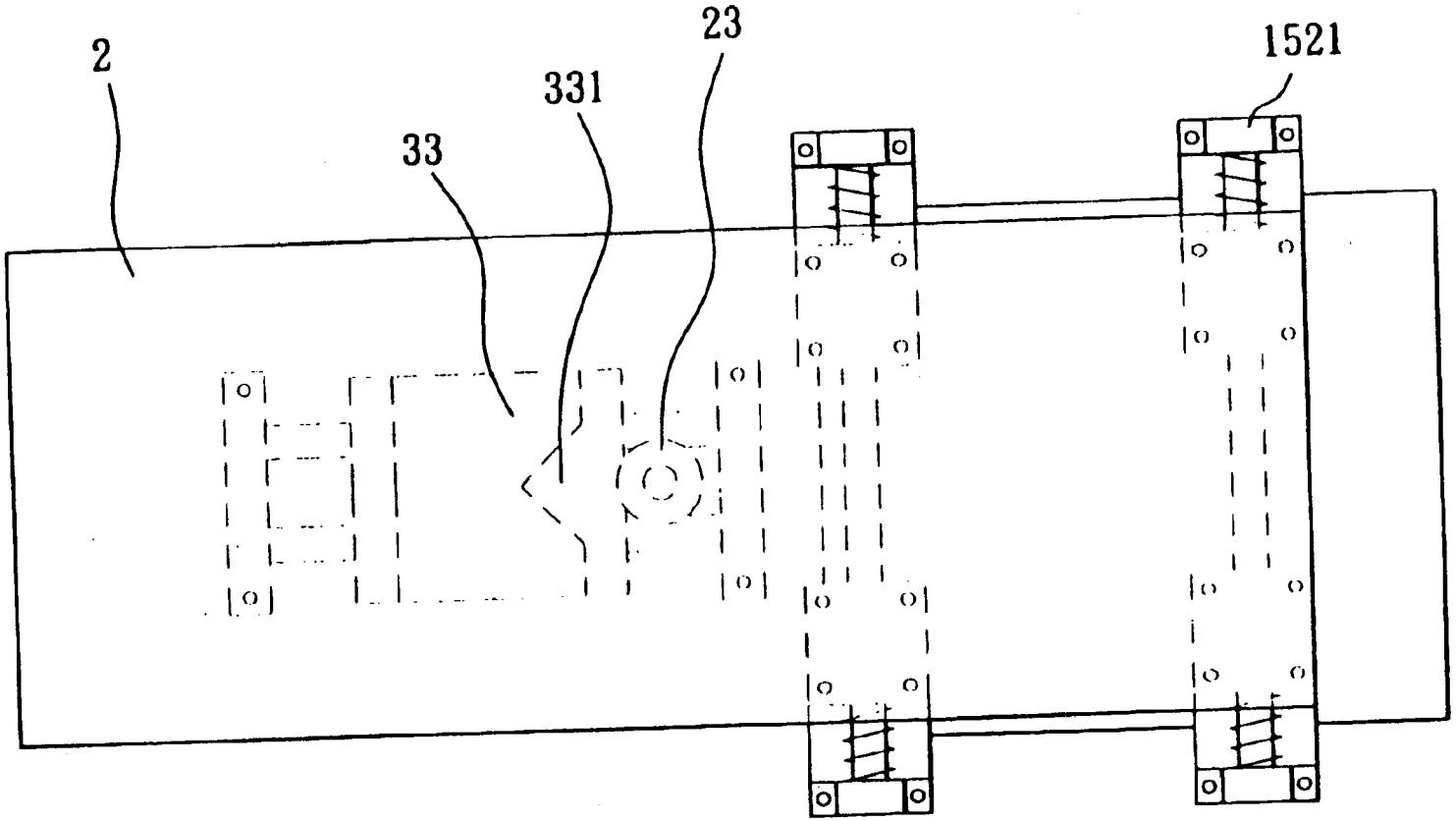
FIG. 3 is a top plain view of the present invention, showing the workpiece carrier moved to the printing/drying position before engagement of the V-notch of the stop block with the roller at the workpiece carrier.
Figure 7:
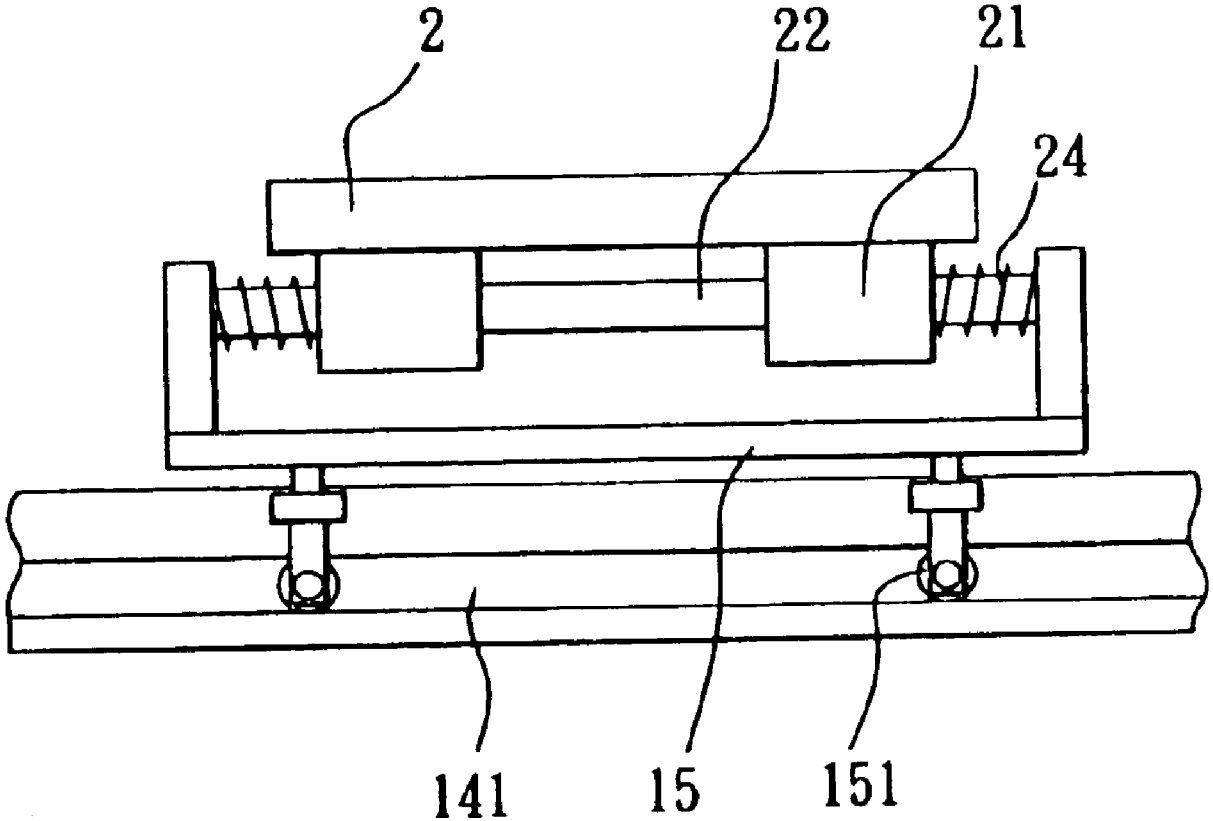
FIG. 7 is a side plain view of the workpiece carrier positioning structure according to the present invention.

Referring to FIGS. 2, 4, and 7, a workpiece carrier positioning structure is provided for controlling the positioning of the workpiece carrier 2 of each carriage 13. The workpiece carrier positioning structure comprises an air cylinder 3 provided in the auto printing and drying machine 1 at a predetermined location, two parallel guide rails 32 arranged adjacent to the air cylinder 3, a slide 31 mounted on the guide rails 32 and driven by the air cylinder 3 to move forwards/backwards along the guide rails 32, a stop block 33 fixedly provided at the top side of the slide 31, the stop block 33 having a V-notch 331 in one side, namely, the front side, a roller 23 pivoted to the bottom center of the workpiece carrier 2 of each carriage 13, a plurality of locating blocks 21 fixedly provided at the bottom side of the workpiece carrier 2 of each carriage 13, a plurality or axles 22 respectively inserted through a respective through hole (not shown) in each of the locating blocks 21, the axles 22 each having two ends fixedly connected to symmetrical lugs 1521 at two sides of the frame 152 of the rack 15 of the carriage 13, a plurality of compression springs 24 respectively mounted on the axles 22 and bilaterally stopped between the locating blocks 21 and the lugs 1521 to keep the workpiece carrier 2 in balance when receiving a pressure from one lateral side. The rack 15 of the carriage 13 has rollers 151 respectively coupled to the two parallel sliding grooves 141 of a track 14 in the machine base of the auto printing and drying machine 1, for enabling the workpiece carrier 2 to be moved with the carriage 13 along the track 14.

Figure 5:
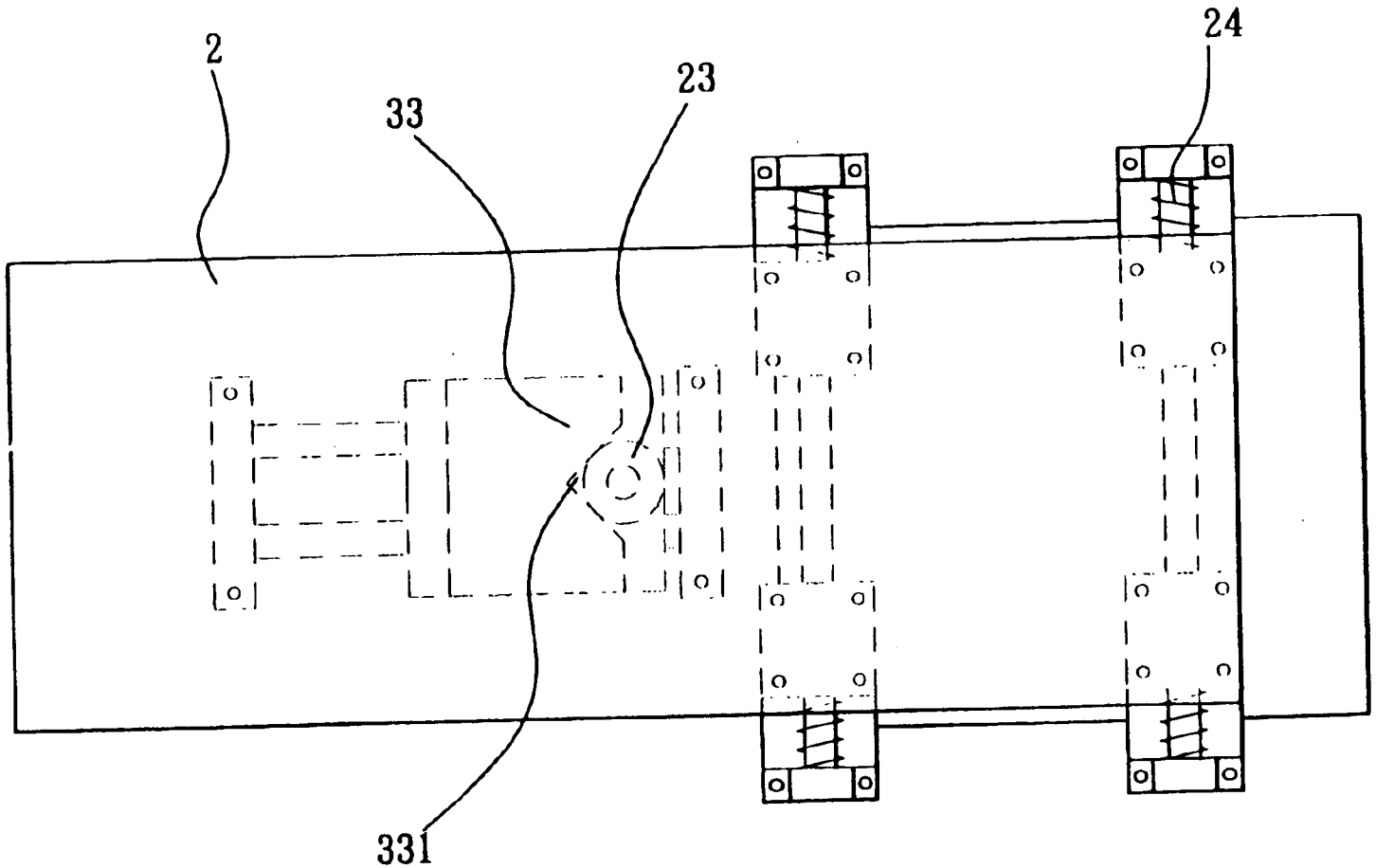
FIG. 5 is similar to FIG. 3 but showing the V-notch of the stop block engaged with the roller at the workpiece carrier.
Figure 6:
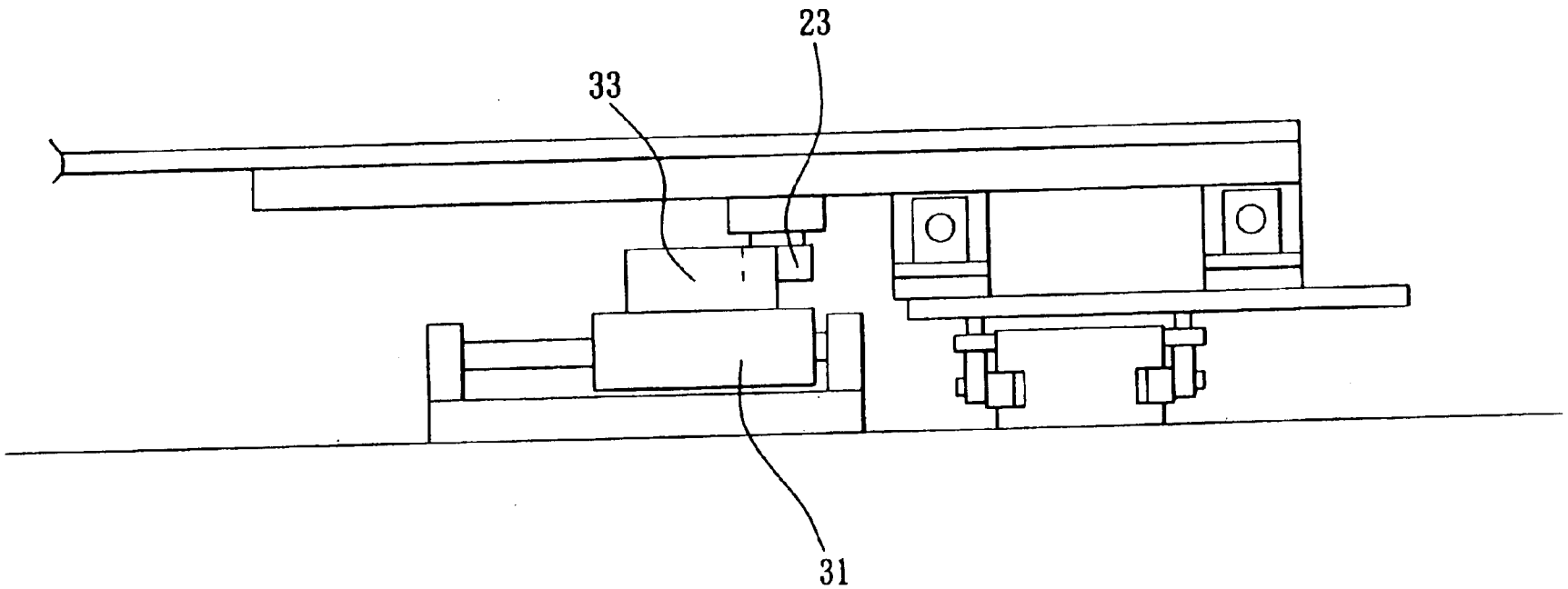
FIG. 6 is a front plain view of FIG. 5.

When the workpiece carrier 2 moved with the respective carriage 13 to a position close to the air cylinder 3, the air cylinder 3 is driven to move the slide 31 subject to the running of a computer program, causing the V-notch 331 of the stop block 33 to be stopped against the roller 33 (see FIGS. 5 and 6), and therefore the workpiece carrier 2 is held in position for printing or drying. Because the compression springs 24 support the workpiece carrier 2 at two sides, the workpiece carrier 2 can be moved transversely between the lugs 1521 at two sides or the frame 152 of the rack 15 of the carriage 13 when receiving a pressure from one lateral side. When the external pressure disappeared, the spring force of the compression springs 24 automatically move the workpiece carrier 2 back to the center position. Therefore, when the roller 23 of the workpiece carrier 2 stopped at the V-notch 331 of the locating block 33, the compression springs 24 automatically hold the workpiece carrier 2 in balance for printing or drying by the corresponding printing module 11 or driving module 12 accurately.

A prototype of workpiece carrier positioning structure for auto printing and drying machine has been constructed with the features of the annexed drawings of FIGS. 1 through 7. The workpiece carrier positioning structure for auto printing and drying machine functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A workpiece carrier positioning structure used in an auto printing and drying machine for controlling positioning of a workpiece carrier fixedly carried on a carriage sliding in a track, for enabling said workpiece carrier to be positively maintained in a printing/drying position, the workpiece carrier positioning structure comprising:

a roller pivoted to the center of a bottom side of said workpiece carrier;

a rack fixedly provided in said carriage and adapted to support said workpiece carrier on said carriage, said rack having pairs of upright lugs symmetrically disposed at two opposite lateral sides thereof;

a plurality of axles connected in parallel between the upright lugs at the two opposite lateral sides of said rack;

a plurality of locating blocks fixedly provided at said bottom side of said workpiece carrier and respectively coupled to said axles for enabling said workpiece carrier to be moved transversely between the upright lugs at the two opposite lateral sides of said rack;

a plurality of compression springs respectively mounted on said axles and bilaterally supported between said upright lugs and said locating blocks to keep said workpiece carrier in balance;

an air cylinder two parallel guide rails arranged adjacent to said air cylinder;

a slide mounted on said guide rails; said air cylinder adapted to reciprocate said slide along said guide rails and a stop block fixedly provided at a top side of said slide, said stop block having a V-notch disposed in one side thereof and adapted to receive said roller to hold said workpiece carrier in said printing/drying position.

* * * * *